US007749048B2

(12) United States Patent
Wang et al.

(10) Patent No.: US 7,749,048 B2
(45) Date of Patent: Jul. 6, 2010

(54) POLISHING PAD CONDITIONING PROCESS

(75) Inventors: James C. Wang, Saratoga, CA (US); Hung K. Nguyen, Milpitas, CA (US); Sen-Hou Ko, Cupertino, CA (US); Wei-Yung Hsu, Santa Clara, CA (US)

(73) Assignee: Applied Materials, Inc., Santa Clara, CA (US)

( * ) Notice: Subject to any disclaimer, the term of this patent is extended or adjusted under 35 U.S.C. 154(b) by 0 days.

(21) Appl. No.: 11/744,552

(22) Filed: May 4, 2007

(65) Prior Publication Data

US 2007/0298689 A1 Dec. 27, 2007

Related U.S. Application Data

(60) Provisional application No. 60/801,933, filed on May 19, 2006.

(51) Int. Cl.
*B24B 53/00* (2006.01)
*B24B 51/00* (2006.01)

(52) U.S. Cl. ..... 451/5; 451/56; 451/41

(58) Field of Classification Search ..... 451/5, 451/56, 443, 444, 72, 57, 41, 287, 288
See application file for complete search history.

(56) References Cited

U.S. PATENT DOCUMENTS

| | | | | |
|---|---|---|---|---|
| 5,384,986 | A | 1/1995 | Hirose et al. | |
| 5,651,725 | A * | 7/1997 | Kikuta et al. | 451/41 |
| 5,785,585 | A * | 7/1998 | Manfredi et al. | 451/285 |
| 5,816,891 | A * | 10/1998 | Woo | 451/6 |
| 5,857,898 | A | 1/1999 | Hiyama et al. | |
| 6,022,266 | A * | 2/2000 | Bullard et al. | 451/56 |
| 6,200,199 | B1 | 3/2001 | Gurusamy et al. | |
| 6,575,818 | B2 * | 6/2003 | Jeong | 451/285 |

* cited by examiner

*Primary Examiner*—Robert Rose
(74) *Attorney, Agent, or Firm*—Fish & Richardson

(57) ABSTRACT

A method of operating a polishing apparatus in which a substrate is held with a carrier head supported by a movable support of the polishing apparatus, the substrate is brought into contact with a polishing surface at a polishing station of the polishing apparatus and the substrate is polished, the substrate is removed from the polishing surface, the support moves to transfer the carrier head to a different station of the polishing apparatus, and the polishing surface is conditioned. The conditioning overlaps with at least one of removing the substrate or moving the support.

11 Claims, 2 Drawing Sheets

POLISHING PAD CONDITIONING PROCESS

CROSS REFERENCE TO RELATED APPLICATIONS

Under 35 U.S.C. §119(e)(1), this application claims the benefit of prior U.S. Provisional Application 60/801,933, filed May 19, 2006. The disclosure of the prior application is considered part of (and is incorporated by reference in) the disclosure of this application.

BACKGROUND

The invention relates to conditioning of polishing pads.

Chemical mechanical polishing (CMP) is one accepted method of planarization. This planarization method typically requires that a substrate be mounted on a carrier or polishing head. The exposed surface of the substrate is typically placed against a rotating polishing disk pad or linearly belt pad. The polishing pad can be either a standard pad or a fixed abrasive pad. A standard pad has a durable roughened surface, whereas a fixed-abrasive pad has abrasive particles held in a containment media. The carrier head provides a controllable load on the substrate to push it against the polishing pad. A polishing slurry is typically supplied to the surface of the polishing pad. The polishing slurry includes at least one chemically reactive agent and can also include abrasive particles.

Over time, the polishing process glazes the polishing pad. The glazing phenomenon is a complex combination of contamination, thermal, chemical and mechanical damage to the pad material. When the polisher is in operation, the pad is subject to compression, shear and friction producing heat and wear. Slurry and abraded material from the wafer and pad are pressed into the pores of the pad material and the material itself becomes matted and even partially fused. These effects reduce the pad's roughness and its ability to apply fresh slurry to the substrate. The polishing pad surface is typically "conditioned," whereby the polishing pad surface is deglazed removing trapped slurry, and unmatting or re-expanding the pad material. Conditioning is typically performed by scouring the polishing pad surface with an abrasive device such as a rotating diamond-coated disk.

SUMMARY

In one aspect, the invention is directed to method of operating a polishing apparatus. The method includes holding a substrate with a carrier head supported by a movable support of the polishing apparatus, bringing the substrate into contact with a polishing surface at a polishing station of the polishing apparatus and polishing the substrate, removing the substrate from the polishing surface, moving the support to transfer the carrier head to a different station of the polishing apparatus, and conditioning the polishing surface. The conditioning overlaps with at least one of removing the substrate or moving the support.

Implementations of the invention may include one or more of the following features. Conditioning may overlap with both removing the substrate and moving the support. Conditioning need not overlap with polishing the substrate. Conditioning may have a duration that is about the same as a duration of removing the substrate and moving the support. Moving the support can be rotating the support. The support may be a carousel supporting a plurality of carrier heads. The different station may be a transfer station or another polishing station. Conditioning may include abrading the polishing surface with a rotating conditioning disk. The polishing surface may be a surface of a polishing pad supported on a rotatable platen.

In one aspect, the invention is directed to a computer program product to cause a polishing apparatus to perform the method above.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Figure 1:
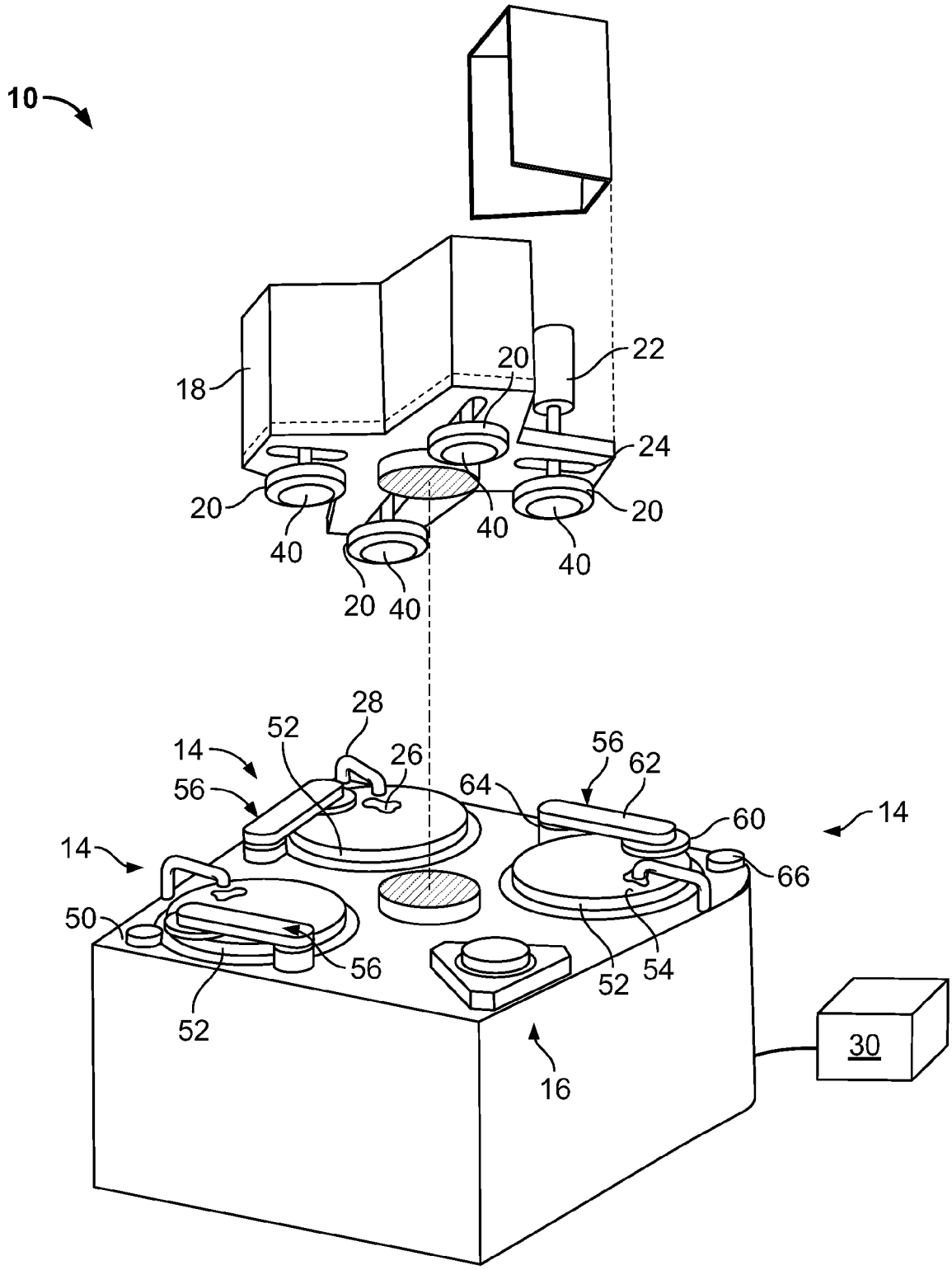
FIG. 1 is a schematic exploded perspective view of a chemical mechanical polishing system.

Referring to FIG. 1, a polishing apparatus 10 includes three polishing stations 14, a substrate transfer station 16, and a rotatable carousel 18 which supports four carrier heads 20. The carrier heads can be independently rotatable by motors 22 and radially oscillatable within slots 24 in a support plate of the carousel. A description of a similar polishing apparatus is found in U.S. Pat. No. 5,738,574, the entire disclosure of which is incorporated by reference. Operation of the polishing apparatus is typically controlled by a programmable computer 30 to polishing substrates 40 held by the carrier heads 20.

Each polishing station 14 includes a rotatable platen 52 which supports a polishing pad 54, and a pad conditioner 56. The platen 52 and conditioner 56 are both mounted to a table top 50 of the polishing apparatus 10. Slurry 26 can be provided to the polishing surface of the polishing pad 54 by a slurry delivery arm 28.

Each pad conditioner 56 includes a conditioner head 60, an arm 62, and a base 64. The arm 62 has a distal end coupled to the conditioner head 60 and a proximal end coupled to the base 64, which sweeps the conditioner head 60 across the surface of the polishing pad 54 to condition the surface by abrasion so as to remove contaminants and retexturize the surface. Each polishing station 14 may also include a cup 66, which contains a cleaning liquid for rinsing or cleaning the conditioner head 60. A description of a suitable conditioner is found in U.S. Pat. Nos. 6,200,199 and 6,033,290, the entire disclosures of which are incorporated by reference.

In a serial polishing operation, a substrate is loaded by a robot arm into to the transfer station 16, from which the substrate is transferred to a carrier head 20. The carousel 18 then rotates, transferring the substrate to one of the polishing stations. At the polishing station, the carrier head lowers the substate into contact with the polishing pad. Slurry is supplied while the carrier head and platen rotate to provide polishing. At the completion of the polishing process at a particular platen, the carrier head lifts the substrate off the polishing pad (this process is sometimes referred to as "dechuck", referring to dechucking the substrate from the pad). The carousel 18 rotates again, carrying the substrate to each polishing station in turn for further processing. Eventually, the carousel returns the polished substrate to the transfer station 16, where the robot arm removes the polished substrate.

Figure 2:
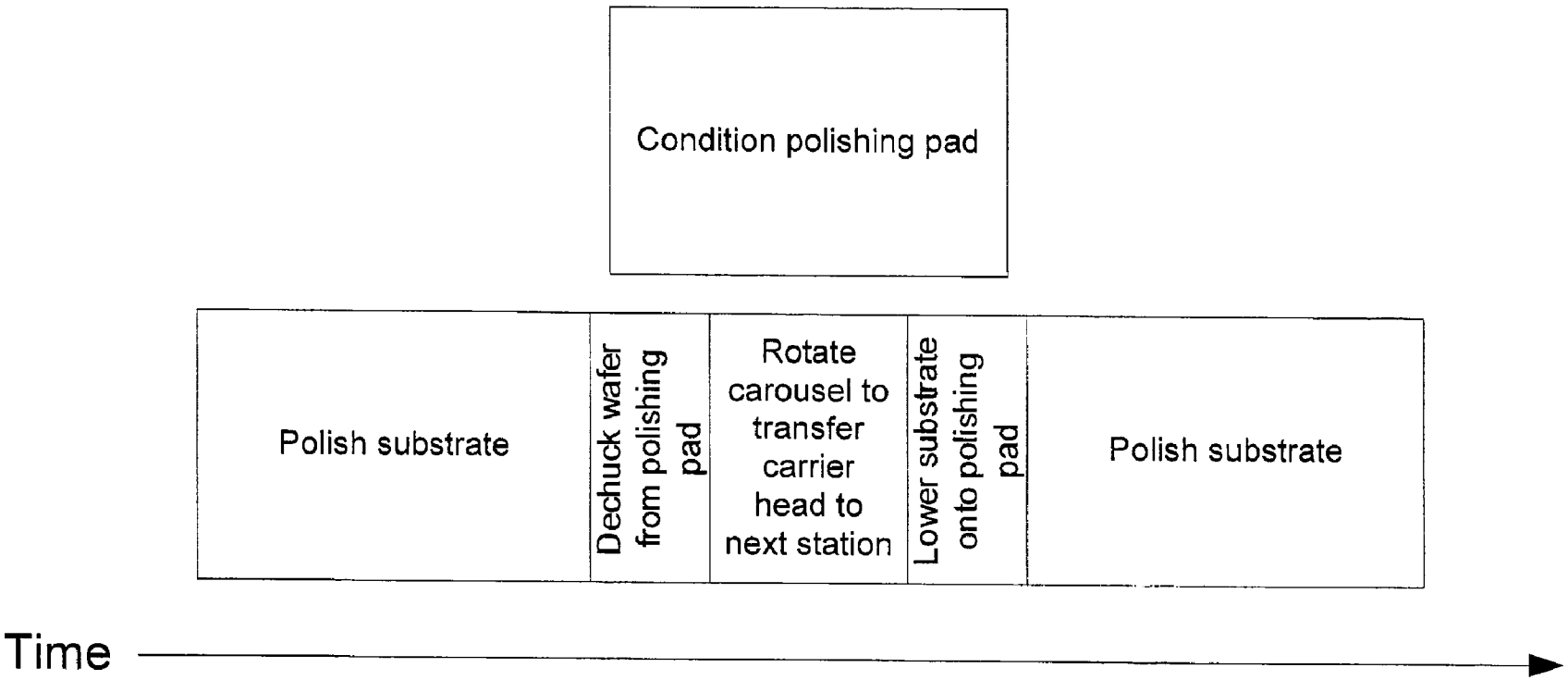
FIG. 2 is a timeline illustrating a method of operating the chemical mechanical polishing system.

Turning now to operation of the conditioner, as shown by FIG. 2, the polishing pad can be conditioned ex-situ, i.e., between polishing. Polishing is generally considered to occur while the substrate is contacting the polishing pad and the platen is rotating.

In particular, the conditioning of the polishing pad can overlap (e.g., at least some portions of the conditioning operation are simultaneous) with the dechucking of the substrate, or overlap with the rotation of the carousel that transports the carrier heads between the polishing stations, or overlap with both. In one implementation, the conditioning is performed for the same length of time that is needed for dechucking of the substrate and rotation of the carousel.

The conditioning could extend partially into the polishing operation, but in one implementation, the polishing and conditioning do not overlap.

In contrast to an ex-situ conditioning technique in which conditioning was performed between polishing but did not overlap dechucking or carousel rotation, the present conditioning method can reduce the total time for a single processing cycle at a given platen, thus potentially providing improved throughput.

The control of the polishing apparatus as described above can be provided by digital electronic circuitry, or by computer software, firmware, or hardware, or by combinations of them. In particular, software for controlling the polishing as described above can be implemented as one or more computer program products, i.e., one or more computer programs tangibly embodied in an information carrier, e.g., in a machine readable storage device or in a propagated signal, for execution by, or to control the operation of, data processing apparatus, e.g., a programmable processor, a computer, or multiple processors or computers. A computer program (also known as a program, software, software application, or code) can be written in any form of programming language, including compiled or interpreted languages, and it can be deployed in any form, including as a stand alone program or as a module, component, subroutine, or other unit suitable for use in a computing environment.

A number of embodiments of the invention have been described. Nevertheless, it will be understood that various modifications may be made without departing from the spirit and scope of the invention. For example, although the polishing system is described with three polishing stations and a transfer station, the system could have a different number of polishing station, such as a single polishing station (in which case, the substrate would be transported directly from the polishing station to a transfer station). Accordingly, other embodiments are within the scope of the following claims.

What is claimed is:

1. A method of operating a polishing apparatus, comprising:

holding a substrate with a carrier head supported by a movable support of the polishing apparatus;

bringing the substrate into contact with a polishing surface at a polishing station of the polishing apparatus and polishing the substrate;

removing the substrate from the polishing surface;

moving the support to transfer the carrier head to a different station of the polishing apparatus; and conditioning the polishing surface, wherein conditioning overlaps with removing the substrate but does not overlap with polishing the substrate.

2. The method of claim 1, wherein conditioning overlaps with both removing the substrate and moving the support.

3. The method of claim 2, wherein conditioning has a duration that is about the same as a duration of the removing the substrate and moving the support.

4. The method of claim 1, wherein moving the support comprises rotating the support.

5. The method of claim 4, wherein the support comprises a carousel supporting a plurality of carrier heads.

6. The method of claim 5, wherein the different station comprises a transfer station or another polishing station.

7. The method of claim 6, wherein conditioning comprises abrading the polishing surface with a rotating conditioning disk.

8. The method of claim 7, wherein the polishing surface comprises a surface of a polishing pad supported on a rotatable platen.

9. A computer program product tangibly embodied in a computer readable medium including instructions for a processor to cause a polishing apparatus to perform operations, the operations comprising:

holding a substrate with a carrier head supported by a movable support of the polishing apparatus;

bringing the substrate into contact with a polishing surface at a polishing station of the polishing apparatus and polishing the substrate;

removing the substrate from the polishing surface;

moving the support to transfer the carrier head to a different station of the polishing apparatus; and conditioning the polishing pad, wherein conditioning overlaps with removing the substrate but does not overlap with polishing the substrate.

10. The computer program product of claim 9, the method of claim 1, wherein conditioning overlaps with both removing the substrate and moving the support.

11. The computer program product of claim 10, wherein conditioning has a duration that is about the same as a duration of the removing the substrate and moving the support.

* * * * *

UNITED STATES PATENT AND TRADEMARK OFFICE

CERTIFICATE OF CORRECTION

PATENT NO. : 7,749,048 B2
APPLICATION NO. : 11/744552
DATED : July 6, 2010
INVENTOR(S) : James C. Wang et al.

It is certified that error appears in the above-identified patent and that said Letters Patent is hereby corrected as shown below:

Col. 4, lines 48 and 49; Claim 10, after "claim 9," delete "the method of claim 1,".

Signed and Sealed this

Twenty-third Day of November, 2010

David J. Kappos

David J. Kappos
*Director of the United States Patent and Trademark Office*